US006088885A

United States Patent [19]

Galbreath

[11] Patent Number: 6,088,885

[45] Date of Patent: Jul. 18, 2000

[54] STRAP RETAINER

[76] Inventor: John Alexander Galbreath, 2516 Chestnut Woods Ct., Reisterstown, Md. 21136

[21] Appl. No.: 09/318,153

[22] Filed: May 25, 1999

[51] Int. Cl.[7] ..... A44B 13/00; A63B 29/00

[52] U.S. Cl. ..... 24/265 AL; 24/573.1; 24/573.5

[58] Field of Search ..... 24/265 AL, 573.5, 24/573.1, 701, 666, 543, 68 CD, 116 A, 191, 197

[56] References Cited

U.S. PATENT DOCUMENTS

| | | | |
|---|---|---|---|
| 2,983,980 | 5/1961 | Hamel | 24/573.5 |
| 4,775,121 | 10/1988 | Carty | 24/543 |
| 4,930,194 | 6/1990 | Frechin | 24/573.5 |
| 4,977,649 | 12/1990 | Smetz | 24/573.1 |
| 5,177,837 | 1/1993 | Rekuc | 24/200 |
| 5,263,726 | 11/1993 | Wood | 28/33.992 |
| 5,333,361 | 8/1994 | Schaede | 24/16 PB |
| 5,577,304 | 11/1996 | Simond | 24/573.5 |
| 5,669,118 | 9/1997 | Frano et al. | 24/265 AL |
| 5,781,970 | 7/1998 | Anscher | 24/265 AL |
| 5,937,745 | 8/1999 | Boe | 24/543 |

*Primary Examiner*—Victor N. Sakran

[57] ABSTRACT

The device is a strap retainer having a generally arcuate retainer body 10 and a generally straight, cylindrical post 11. One end of retainer body 10 is integrally connected to one end of post 11. Two catch arms 12*a*&*b* are located on the free end of retainer body 10, and a post catch element 13 is located on the free end of post 11. Catch arms 12*a*&*b* and post catch element 13 correspond with one another, and adapt the free ends of retainer body 10 and post 11 for closure. To install the retainer, a strap loop is first placed over post 11. The object that will serve to anchor the strap, such as a post or a portion of a shopping cart frame, is passed between the open ends of retainer body 10 and post 11. The open end of post 11 is then urged toward the open end of retainer body 10 until post catch element 13 contacts catch arms 12*a*&*b*. Post catch element 13 urges catch arms 12*a*&*b* outward, and then post catch element 13 passes between and is retained by catch arms 12*a*&*b*.

8 Claims, 9 Drawing Sheets

STRAP RETAINER

CROSS-REFERENCES TO RELATED APPLICATIONS

Not Applicable

BACKGROUND OF THE INVENTION

1. Field of the Invention

This invention is in the area of strap retainers, specifically a strap retainer which provides a convenient and secure means to attach a strap to an object, and which has a simpler construction and method of operation than prior art strap retainers.

2. Description of the Related Art:

Molded plastic strap retainers are known in the art, two examples of such a device being disclosed in U.S. Pat. No. 5,669,118 to Frano et al. and U.S. Pat. No. 5,781,970 to Anscher.

The device of Frano comprises a receptacle end and a post, with the open end of the post having a stem supporting a bulbous head. To lock the retainer, the post is first pushed backward to insert the head and stem of the post into the larger of two apertures in the receptacle end of the retainer, and then the post is pulled forward to lock the head and stem of the post into the smaller of the two receptacle apertures. This method of operation entails a two-step process—pushing the post forward and then pulling it back—which is unnecessarily time-consuming, particularly when large numbers of straps need to be attached.

Moreover, Frano's device is of relatively complex construction, with many different intercommunicating aspects—inclined ramps, lips, notches, etc. Such a complex approach is not necessary to perform the function of conveniently and securely retaining the strap. Mold/tooling effort and cost for a complex device like this are higher than they would be for a device of simpler construction.

The device of Anscher also entails a two-step operation, wherein the locking pawl is first inserted into the receptacle cavity, and the locking pawl is then slid toward the free end of the receptacle to lock the two ends of the retainer together. As with the device of Frano, this two-step operation is unnecessarily time consuming and not very convenient, particularly when large numbers of straps need to be attached.

While Anscher's device is of simpler construction than that of Frano, it nevertheless comprises many intercommunicating elements—ridges, shoulder elements, locking teeth, etc. As such, mold/tooling effort and cost for this device is higher than it would be for a device of simpler construction.

Further, both of these prior art devices are constructed such that once they are locked, they remain in a locked position permanently. They cannot be easily unlocked and removed, even when one may wish to do so. This is a disadvantage, since if the strap wears, or a buckle attached to the other end of the strap breaks, the strap cannot be easily removed from the strap retainer and replaced.

Thus it can be seen that a strap retainer which has a simpler construction and simpler method of operation than previous strap retainers, but yet which provides a highly effective means to attach a strap to an object, would be a significant improvement.

Accordingly, several objects and advantages of my invention are:

The invention is faster and easier to install than prior art devices. Locking the retainer is a one-step, one-movement process, wherein the post end of the retainer is pushed straight into the receptacle end and locks into place automatically.

The invention's simple construction minimizes mold/tooling effort and cost, and maximizes manufacturing efficiency.

The locking action is secure—once the retainer is locked in place, the harder the strap is pulled, the more force is exerted to push the catch arms together. The flange provides additional strength, and prevents disengagement of the retainer under high levels of stress.

The retainer is easily removable, by pushing the post back into the catch arms, thereby spreading apart the catch arms, and then holding the catch arms in a spread-apart position with the tip of a finger, pen, or other readily available item while withdrawing the post. However, the retainer cannot be inadvertently unlocked—the specific movements described above are required.

Further objects and advantages of my invention will become apparent from a consideration of the drawings and ensuing description.

SUMMARY OF THE INVENTION

This invention is in the area of strap retainers, specifically a strap retainer which provides a convenient and secure means to attach a strap to an object, and which has a simpler construction and method of operation than prior art strap retainers.

DETAILED DESCRIPTION OF THE INVENTION

Figure 1:
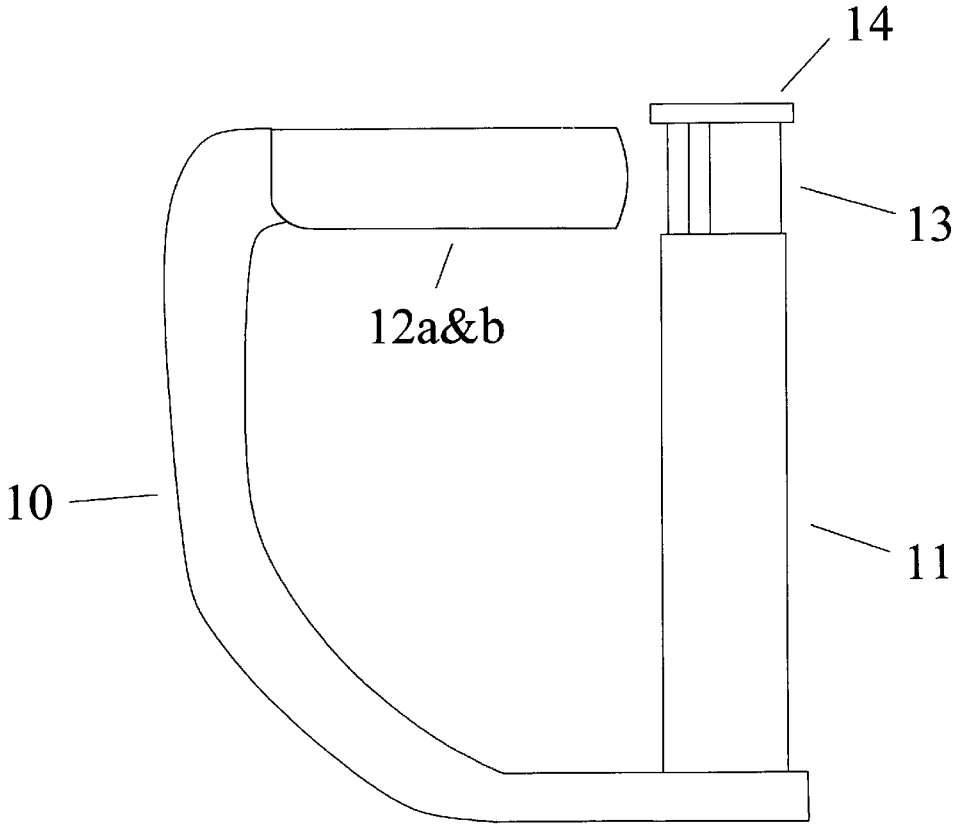
FIG. 1 is a side view of the retainer, in an unengaged position.
Figure 2:
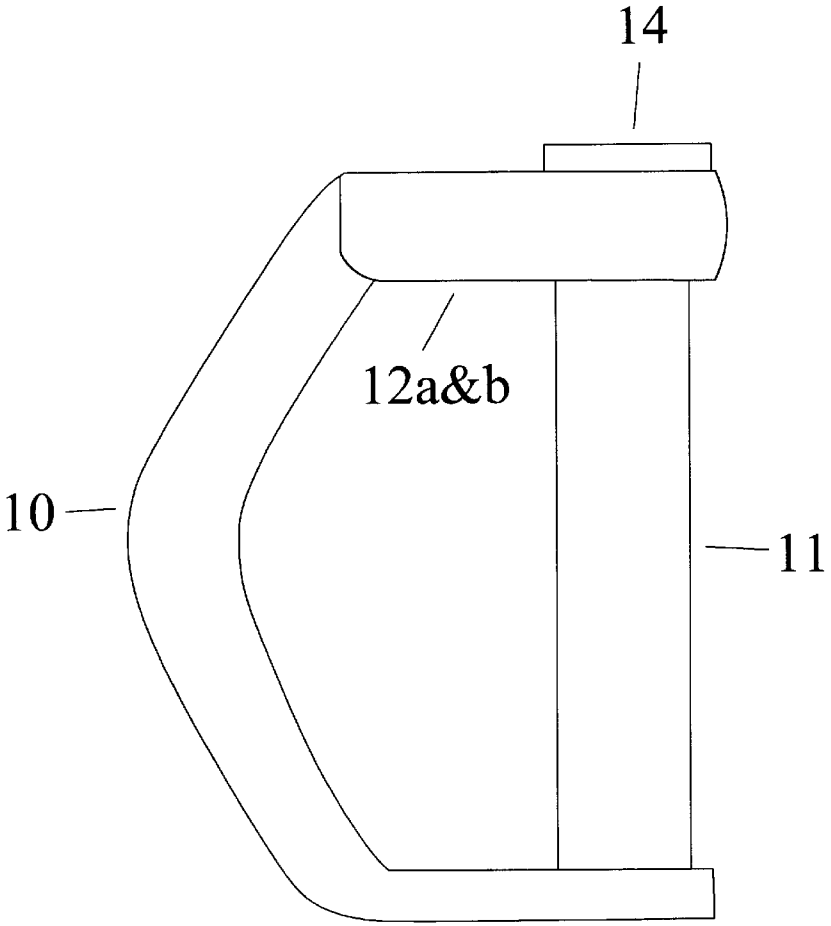
FIG. 2 is a side view of the retainer, in an engaged and locked position.
Figure 3:
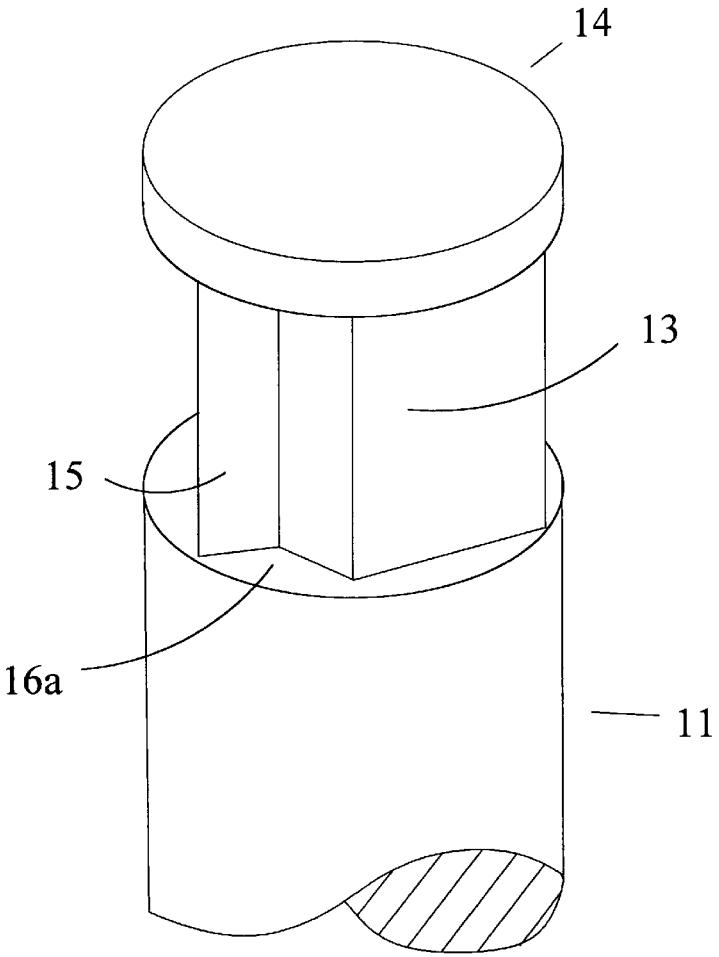
FIG. 3 provides detail on the post catch element.
Figure 4:
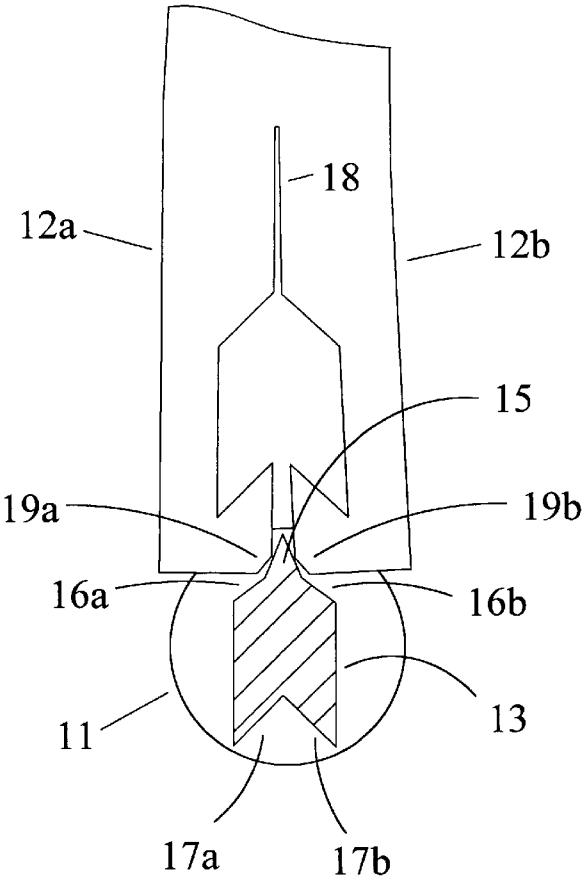
FIG. 4 is a top view of the catching action, with the flange cut away, as the post and post catch element are being initially inserted into the catch arms.
Figure 5:
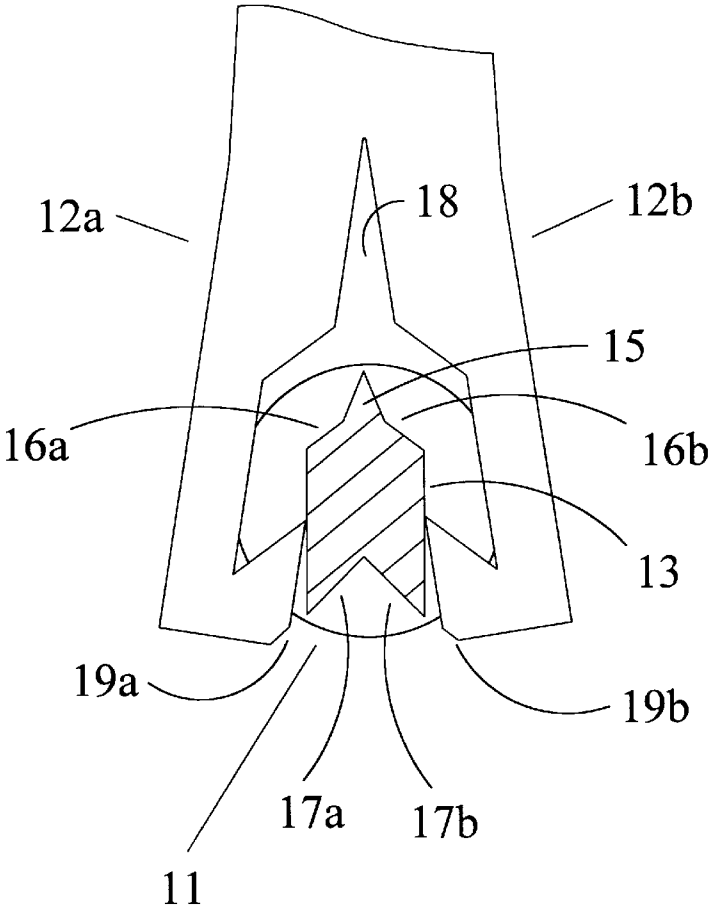
FIG. 5 is a top view of the catching action, with the flange cut away, showing the post and post catch element about halfway inserted into the catch arms.

The following provides a list of the reference characters used in the drawings:

10. Retainer body
11. Post
12*a*&*b*. Catch arms
13. Post catch element
14. Flange

15. Wedge
16*a*&*b*. Recesses
17*a*&*b*. Locking facets
18. Slit
19*a*&*b*. Entry bevels
20. Single catch arm (alternative embodiment)
21. Post (alternative embodiment)
22. Single entry bevel (alternative embodiment)
23. Wedge (alternative embodiment)
24. Single recess (alternative embodiment)
25. Post catch element (alternative embodiment)
26. Single locking facet (alternative embodiment)
27. Slit (alternative embodiment)

FIG. 1 is a side view of the strap retainer, illustrating its major elements. A generally arcuate retainer body 10 and a generally straight, cylindrical post 11 form the main body of the device. One end of retainer body 10 is integrally connected to one end of post 11. Two catch arms 12*a*&*b* are located on the free end of retainer body 10, and a post catch element 13 is located on the free end of post 11. Catch arms 12*a*&*b* and post catch element 13 correspond with one another, and adapt the free ends of retainer body 10 and post 11 for closure. A circular flange 14, located on post 11 above post catch element 13, acts to strengthen the retainer against separation under high pulling stresses.

FIGS. 3–7 provide detail on post catch element 13 and catch arms 12*a*&*b*. A wedge 15 is located at the leading edge of post catch element 13, and recesses 16*a*&*b* are located on each side of post catch element 13. Locking facets 17*a*&*b* are located at the trailing edges of post catch element 13. A slit 18 is located between catch arms 12*a*&*b*. Entry bevels 19*a*&*b* are located on the post-proximate ends of catch arms 12*a*&*b*, to facilitate insertion of post 11 into retainer body 10.

The device is formed from a material suitably flexible and resilient such that catch arms 12*a*&*b* can flex outward, and then spring back, upon insertion of post 11 into retainer body 10, and such that the arcuate portions of retainer body 10 can themselves flex upon insertion of post 11 into retainer body 10. Post 11, however, is of sufficient diameter to be relatively rigid in nature.

To install the strap retainer, a strap loop is first placed over post 11. The object that will serve to anchor the strap, such as a post or a portion of a shopping cart frame, is passed between the open ends of retainer body 10 and post 11. The open end of post 11 is then urged toward the open end of retainer body 10 until post catch element 13 contacts catch arms 12*a*&*b*. Post catch element 13 urges catch arms 12*a*&*b* outward, and then post catch element 13 passes between and is retained by catch arms 12*a*&*b*.

Figure 6:
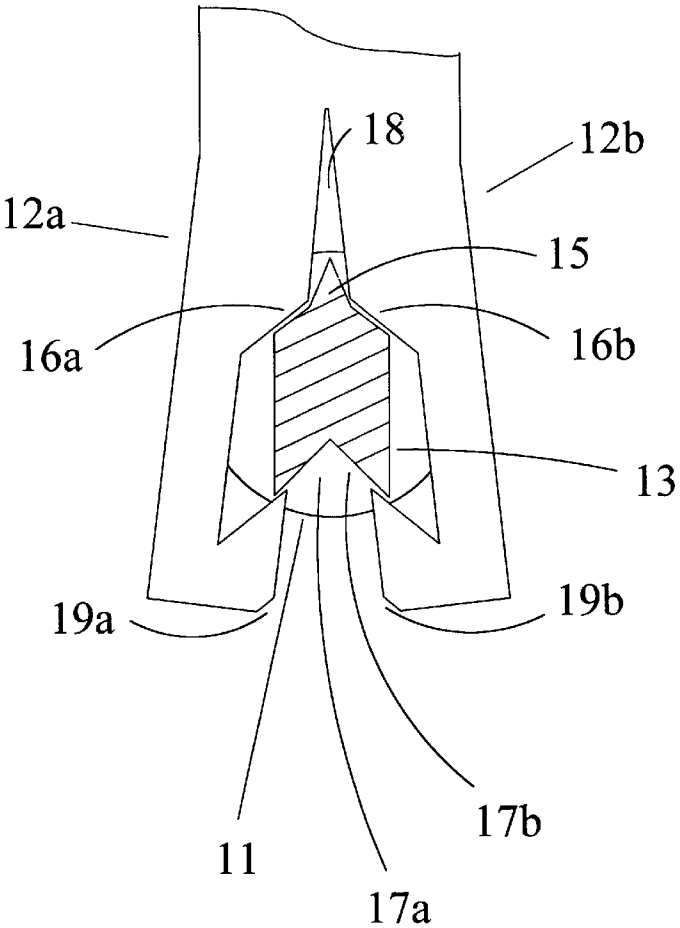
FIG. 6 is a top view of the catching action, with the flange cut away, showing the post and post catch element in their furthest-inserted positions.
Figure 7:
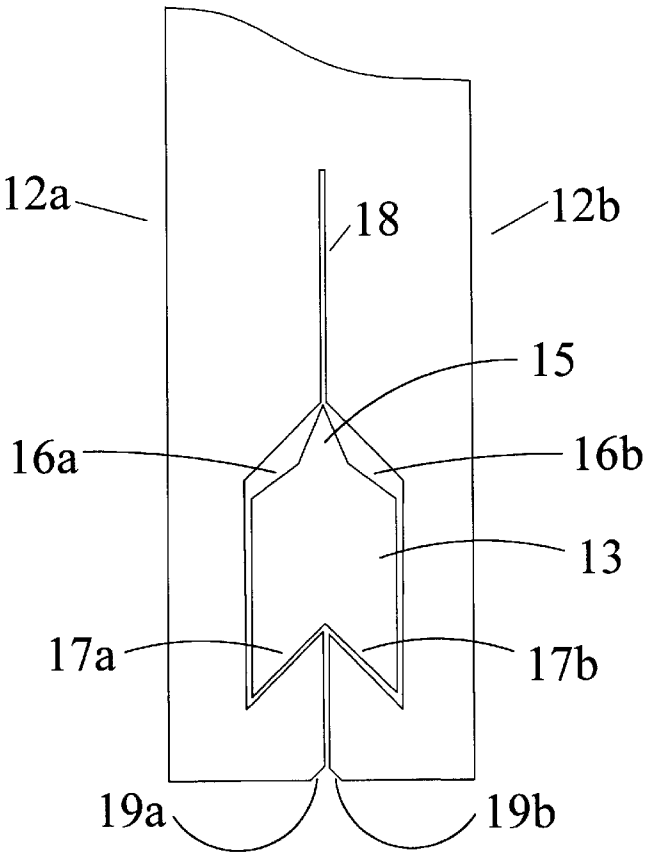
FIG. 7 is a top view of the catching action, with the flange cut away, showing the post and post catch element fully locked within the catch arms.

The catching action is detailed in FIGS. 4–7: wedge 15 on post catch element 13 contacts catch arms 12*a*&*b* at a point between entry bevels 19*a*&*b*. First, wedge 15 urges catch arms 12*a*&*b* apart, causing catch arms 12*a*&*b* to flex outward. Next, the shoulders formed by recesses 16*a*&*b* urge catch arms 12*a*&*b* further apart, allowing post catch element 13 to pass further into catch arms 12*a*&*b*. As shown in FIG. 6, when the trailing edges of post catch element 13 have penetrated past the post-contacting points of catch arms 12*a*&*b*, catch arms 12*a*&*b* begin to spring back to an unflexed position. Recesses 16*a*&*b* provide the additional clearance necessary to allow this springing-back action.

At this point, the inner surfaces of catch arms 12*a*&*b*, pushing on recesses 16*a*&*b* and wedge 15, urge post catch element 13 backward until catch arms 12*a*&*b* have completely returned to an unflexed position and post catch element 13 is fully retained by catch arms 12*a*&*b*. It can be appreciated that when post catch element 13 is in the retained position, pulling on a strap attached to post 11 only serves to cause locking facets 17*a*&*b* to press catch arms 12*a*&*b* more tightly together. Thus, post 11 is locked together with retainer body 10.

Figure 8:
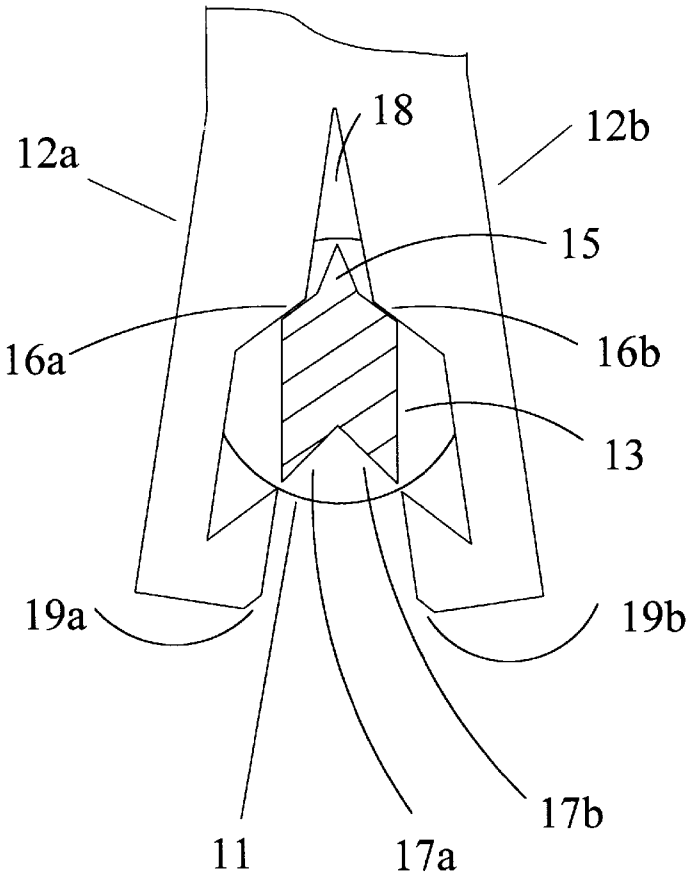
FIG. 8 is a top view of the catching action, with the flange cut away, showing the catch arms and post catch element in positions which will allow the post to be unlocked from the retainer body.

To unlock post 11 from retainer body 10, post 11 is pushed into retainer body 10 until the points of catch arms 12*a*&*b* have cleared the trailing edges of post catch element 13, as illustrated in FIG. 8. At this point, the tip of a finger, a pen, or other readily available object can be used to hold catch arms 12*a*&*b* apart while post catch element 13 is withdrawn, thereby unlocking post 11 from retainer body 10. It can be appreciated that if catch arms 12*a*&*b* are not held apart, post catch element 13 cannot be withdrawn, and will simply return to the retained position within catch arms 12*a*&*b*. Thus, the strap retainer can be easily but not inadvertently unlocked—unlocking requires a certain sequence of deliberate actions.

Figure 9:
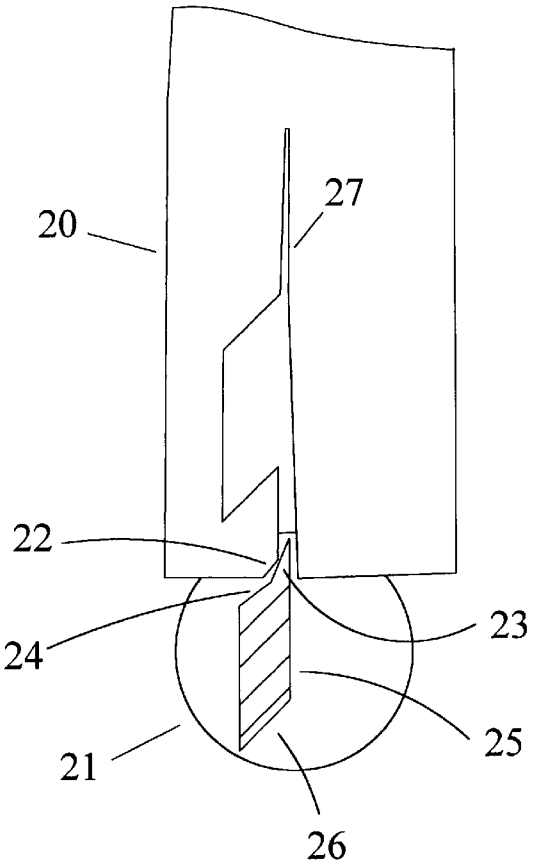
FIG. 9 is a top view of the catching action, with the flange cut away, of an alternative embodiment employing one catch arm, instead of two catch arms as in the main embodiment.

FIG. 9 illustrates an alternative embodiment wherein a single catch arm 20 is employed, instead of two as in the main embodiment. A slit 27 separates single catch arm 20 from the main body of the device, and a single entry bevel 22 is located on single catch arm 20. A post 21 has a post catch element 25 located thereon, and a wedge 23, a single recess 24, and a single locking facet 26 are located on, and form the shape of, said post catch element 25. Other parts, and other operating steps, are the same as in the main embodiment.

Thus the reader will see that this invention provides a simple, yet very effective means for attaching a strap to an object.

While my above description contains many specificities, these shall not be construed as limitations on the scope of the invention, but rather as exemplifications of embodiments thereof. Many other variations are possible. Several such examples follow:

The shape of the retainer body can be different than the generally arcuate shape shown in the main embodiment, and the shape of the post may also be different than the cylindrical, generally straight shape shown.

The shape of the post catch element, and that of the corresponding inner surfaces of the catch arms, can be different than the wedge/arrowhead shape shown in the main embodiment. All that is required is that the post catch element, and the inner surfaces of the catch arms, are appropriately shaped to allow the post catch element to pass through the catch arms and be retained within them.

The post catch element can be of different sizes, relative to the diameter of the post. As just one example, a "thinner" post catch element, having less breadth between its parallel side walls, would reduce the amount of catch arm flex needed to capture and retain the post catch element.

The height of the post catch element—that is, the distance between the top and bottom of the post catch element—can be different than that shown in the main embodiment. For example, an increased height would dictate a correspondingly increased height for the catch arms, but would yield a greater locking facet catch surface area over which to spread a pulling force exerted by the strap.

The diameter of the flange can be increased, which would decrease the possibility that a strap loop would inadvertently slip off the post during shipment of a strap & strap retainer assembly. Of course, the flange needs to be sufficiently sized such that the strap loop can be easily placed over the post. The top edges of the flange can also be beveled to facilitate placing the strap loop over the post.

The flange can be of square or rectangular shape, rather than the circular shape of the main embodiment. A square or rectangular shape would "cover" more of the top surface of the catch arms, providing more flange area and further strengthening the retainer against high pulling stresses.

An additional flange can be added to the post, just below the post catch element. This bottom flange would serve to further strengthen the retainer against high pulling stresses.

It can be appreciated that in the main embodiment, the flat cross-sectional area of the post surrounding the bottom of the post catch element already acts as a sort of bottom flange.

On the other hand, the flange or flanges can be eliminated, which would simplify the retainer. However, this would likely reduce the strength of the retainer under high pulling stresses.

The bottom leading edge of the flange, and the leading edge of the post at the bottom of the post catch element, can be beveled to facilitate insertion of the post into the retainer body.

The device can be made non-removable by changing the leading edge of the post catch element from a wedge shape to a square shape—that is, squaring off the tip of the wedge. On insertion of the post into the retainer body, as the post catch element is urged into the retained position by the springing-back action of the catch arms, the squared-off tip of the wedge would move into place against corresponding square facets located on the inner surfaces of the catch arms, thus preventing any subsequent pushing in of the post.

The length of the slit between the catch arms can be different than that shown in the main embodiment. For example, a longer slit would increase the ease with which the catch arms flex outward. A circular cutout can also be added at the non-post-proximate end of the slit, to facilitate the outward flexing of the catch arms and prevent any potential fatigue cracking of the retainer body at that end of the slit.

One catch arm may be employed, instead of the two catch arms of the main embodiment. A top view of the catching action of this alternative embodiment is shown in FIG. 9.

Accordingly, the scope of the invention should be determined not by the embodiments illustrated, but by the appended claims and their legal equivalents.

I claim:

1. A strap retainer, comprising:

(a) an elongated body having a first end and a second end, and (b) at least one catch arm located on said first end, and (c) a catch element located on said second end and adapted for closure with said catch arm, wherein joining together said first and second ends of said strap retainer entails urging said catch element into said catch arm, causing said catch arm to spring outward and then spring back, thereby allowing said catch element to first pass by, and then be retained by, said catch arm, wherein said catch arm and catch element each is provided with a corresponding appropriately-shaped retaining means on said catch arm and catch element at the proximate end of each, for securing and retaining said catch element within said catch arm and for securing said strap retaining device.

2. The device of claim 1, wherein a beveled surface is located on the catch element-proximate end of said catch arm, thereby facilitating the urging of said catch element into said catch arm.

3. The device of claim 1 wherein two catch arms are located on said first end.

4. The device of claim 3, wherein beveled surfaces are located on the catch element-proximate ends of said catch arms, thereby facilitating the urging of said catch element into said catch arms.

5. The device of claim 1, wherein said elongated body comprises a generally arcuate first part connected to said catch arm, and a cylindrical, generally straight second part connected to said catch element.

6. The device of claim 1, wherein said catch element has a wedge-shaped leading edge, two generally straight sides, and two angular locking facets located at the trailing edges thereof.

7. The device of claim 1, wherein a flange is located on said second end above said catch element, said flange sliding over said catch arm as said first and second ends of said strap retainer are joined together.

8. The device of claim 1, wherein said strap retainer is formed of one piece from a material selected from the group comprising acetal, polypropylene, and nylon.

* * * * *

UNITED STATES PATENT AND TRADEMARK OFFICE

CERTIFICATE OF CORRECTION

PATENT NO. : 6,088,885
DATED : July 18, 2000
INVENTOR(S) : John Alexander Galbreath It is certified that error appears in the above-identified patent and that said Letters Patent is hereby corrected as shown below:

Title page,
Item [75] inventor, should read -- John Alexander Galbreath, Reisterstown, MD. --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*

US006088885C1

(12) EX PARTE REEXAMINATION CERTIFICATE (5541st)

United States Patent
Galbreath

(10) Number: US 6,088,885 C1
(45) Certificate Issued: Oct. 3, 2006

(54) STRAP RETAINER

(75) Inventor: John Alexander Galbreath, 2516 Chestnut Woods Ct., Reisterstown, MD (US) 21136

(73) Assignee: John Alexander Galbreath, Reisterstown, MD (US)

Reexamination Request:
No. 90/007,032, May 6, 2004

Reexamination Certificate for:

| | |
|---|---|
| Patent No.: | **6,088,885** |
| Issued: | **Jul. 18, 2000** |
| Appl. No.: | **09/318,153** |
| Filed: | **May 25, 1999** |

Certificate of Correction issued Sep. 25, 2001.

(51) Int. Cl.
*A44B 13/00* (2006.01)
*A63B 29/00* (2006.01)

(52) U.S. Cl. ..... 24/265 AL; 24/579.09; 24/DIG. 35

(58) Field of Classification Search ..... None
See application file for complete search history.

(56) References Cited

U.S. PATENT DOCUMENTS 4,317,262 A * 3/1982 Wells, Jr. ..... 24/16 PB
4,343,066 A 8/1982 Lance
D271,851 S 12/1983 Lance
5,669,118 A 9/1997 Frano et al.
5,781,970 A * 7/1998 Anscher ..... 24/265 AL

* cited by examiner

*Primary Examiner*—Peter C. English

(57) ABSTRACT

The device is a strap retainer having a generally arcuate retainer body 10 and a generally straight, cylindrical post 11. One end of retainer body 10 is integrally connected to one end of post 11. Two catch arms 12a&b are located on the free end of retainer body 10, and a post catch element 13 is located on the free end of post 11. Catch arms 12a&b and post catch element 13 correspond with one another, and adapt the free ends of retainer body 10 and post 11 for closure. To install the retainer, a strap loop is first placed over post 11. The object that will serve to anchor the strap, such as a post or a portion of a shopping cart frame, is passed between the open ends of retainer body 10 and post 11. The open end of post 11 is then urged toward the open end of retainer body 10 until post catch element 13 contacts catch arms 12a&b. Post catch element 13 urges catch arms 12a&b outward, and then post catch element 13 passes between and is retained by catch arms 12a&b.

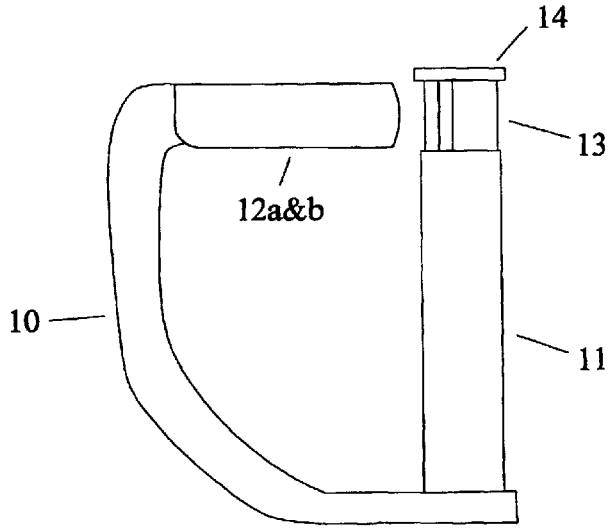

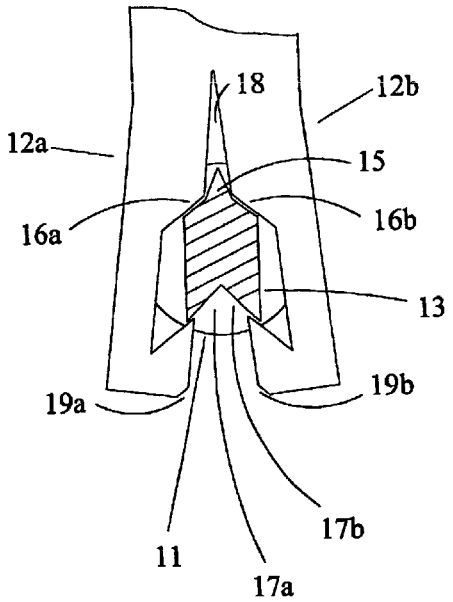

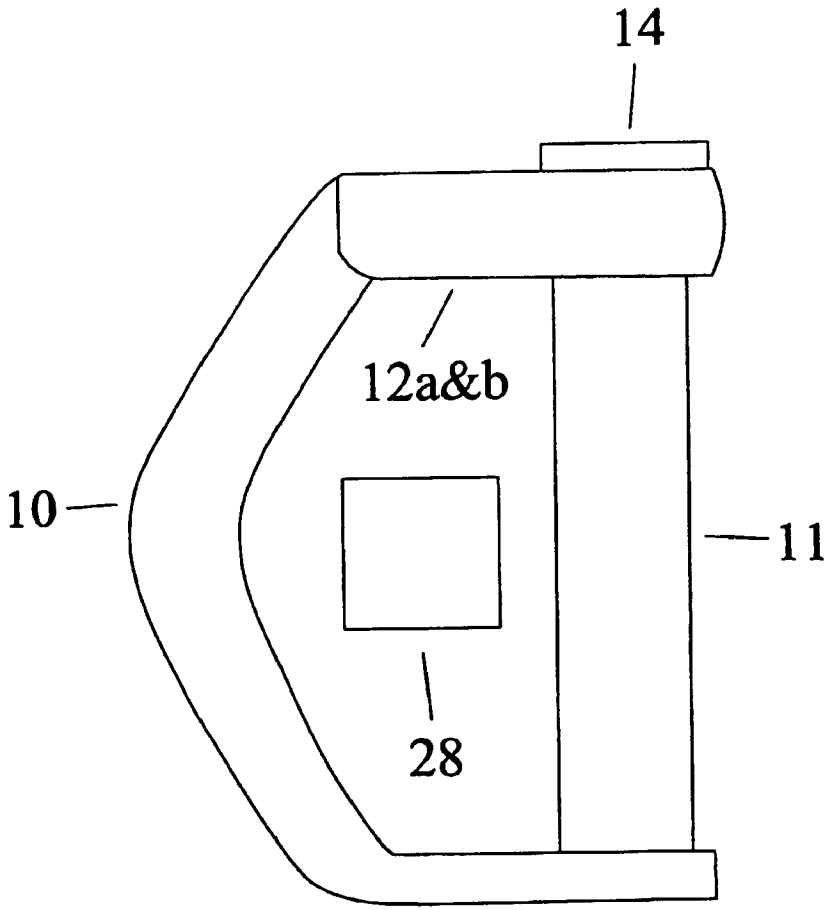
NEW FIGURE 10

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, line 58:

*FIG. 10 is a view of the strap retainer installed around a post or frame.*

Column 3, line 14:

*28. Post or frame*

Column 3, lines 34–35:

*The strap retainer is formed of one piece from a material selected from the group comprising acetal, polypropylene, and nylon.*

Column 3, lines 41–49:

To install the strap retainer, a strap loop is first placed over post 11. The object that will serve to anchor the strap, such as a post or a portion of a shopping cart frame *28*, is passed between the open ends of retainer body 10 and post 11. The open end of post 11 is then urged toward the open end of retainer body 10 until post catch element 13 contacts catch arms 12a&b. Post catch element 13 urges catch arms 12a&b outward, and then post catch element 13 passes between and is retained by catch arms 12a&b.

THE DRAWING FIGURES HAVE BEEN CHANGED AS FOLLOWS:

New FIG. 10 added.

AS A RESULT OF REEXAMINATION, IT HAS BEEN DETERMINED THAT:

Claims 1 and 6 are determined to be patentable as amended.

Claims 2–5, 7 and 8, dependent on an amended claim, are determined to be patentable.

New claims 9–19 are added and determined to be patentable.

1. A strap retainer *combined with an anchor member*, comprising:

(a) an elongated body *adapted for linking a strap to said anchor member by encircling said anchor member and* having a first end and a second end, and (b) at least one catch arm located on said first end, and (c) a catch element located on said second end and adapted for closure with said catch arm, *and*

(*d*) *said anchor member,* wherein joining together said first and second ends of said strap retainer entails urging said catch element [into] *forward toward a joint between said catch element and* said catch arm, *thereby* causing said catch arm to spring outward and then spring back, thereby allowing said catch element to first pass by, and then be retained by, said catch arm, wherein said catch arm and catch element each is provided with a corresponding appropriately-shaped retaining means on said catch arm and catch element at the proximate end of each, for securing and retaining said catch element within said catch arm and for securing said strap retaining device.

6. The device of claim 1, wherein said catch element has a wedge-shaped leading edge, two generally straight sides, and two [angular] *beveled* locking [facets] *faces* located at the trailing edges thereof.

*9. The device of claim 1, wherein said anchor member is a post.*

*10. The device of claim 1, wherein said anchor member is a frame.*

*11. The device of claim 10, wherein said frame is part of a shopping cart.*

*12. A strap retainer, comprising:*

(*a*) *an elongated body having a first end and a second end, and*

(*b*) *at least one catch arm located on said first end, and*

(*c*) *a catch element located on said second end and having at least one beveled locking face adapted for closure with said catch arm by engaging a locking face on said catch arm,*

*wherein joining together said first and second ends of said strap retainer entails urging said catch element forward toward a joint between said catch element and said catch arm, thereby causing said catch arm to spring outward and then spring back, thereby allowing said catch element to first pass by, and then be retained by, said catch arm, wherein said catch arm and catch element each is provided with a corresponding appropriately-shaped retaining means on said catch arm and catch element at the proximate end of each, said means comprising said at least one locking face adapted for closure with said catch arm, for securing and retaining said catch element within said catch arm and for securing said strap retaining device.*

*13. The device of claim 12, wherein a beveled surface is located on the catch element-proximate end of said catch arm, thereby facilitating the urging of said catch element into said catch arm.*

*14. The device of claim 12, wherein two catch arms are located on said first end.*

*15. The device of claim 14, wherein beveled surfaces are located on the catch element-proximate ends of said catch arms, thereby facilitating the urging of said catch element into said catch arms.*

*16. The device of claim 12, wherein said elongated body comprises a generally arcuate first part connected to said catch arm, and a cylindrical, generally straight second part connected to said catch element.*

*17. The device of claim 12, wherein said catch element has a wedge-shaped leading edge, two generally straight sides, and two beveled locking faces located at the trailing edges thereof.*

*18. The device of claim 12, wherein a flange is located on said second end above said catch element, said flange sliding over said catch arm as said first and second ends of said strap retainer are joined together.*

*19. The device of claim 12, wherein said strap retainer is formed of one piece from a material selected from the group comprising acetal, polypropylene, and nylon.*

* * * * *